US011345181B1

(12) United States Patent
Kong

(10) Patent No.: US 11,345,181 B1
(45) Date of Patent: May 31, 2022

(54) SELF-MADE LED LUMINOUS FLOATING OIL FILLING PEN

(71) Applicant: Shenzhen Wingart Art Supplies Co,.Ltd., Shenzhen (CN)

(72) Inventor: Yougen Kong, Shenzhen (CN)

( * ) Notice: Subject to any disclaimer, the term of this patent is extended or adjusted under 35 U.S.C. 154(b) by 0 days.

(21) Appl. No.: 17/123,809

(22) Filed: Dec. 16, 2020

(51) Int. Cl.

| | |
|---|---|
| ***B43K 29/10*** | (2006.01) |
| ***F21V 33/00*** | (2006.01) |
| ***B43K 7/00*** | (2006.01) |
| ***F21Y 115/10*** | (2016.01) |

(52) U.S. Cl.
CPC ..... *B43K 29/10* (2013.01); *B43K 7/005* (2013.01); *F21V 33/0048* (2013.01); *F21Y 2115/10* (2016.08)

(58) Field of Classification Search
CPC ..... B43K 7/005; B43K 29/10; F21V 33/0048; F21Y 2115/10
See application file for complete search history.

(56) References Cited

U.S. PATENT DOCUMENTS 6,238,057 B1 * 5/2001 Chen ..... B43K 29/10 362/101

* cited by examiner

*Primary Examiner* — Jason M Han
(74) *Attorney, Agent, or Firm* — W&KIP

(57) ABSTRACT

Provided is a self-made LED luminous floating oil pen, including an empty pen tube. One end of the empty pen tube is threadedly connected to a plastic shell, and the inner cavity of the empty pen tube is filled with a mineral oil. Two sides of the inner cavity of the empty pen tube are provided with LED lamp beads distributed at equal intervals, and floating action figures are arranged in the inner cavity of the empty pen tube. Glitter and hollow plastic balls are filled in the inner cavity of the empty pen tube.

10 Claims, 3 Drawing Sheets

SELF-MADE LED LUMINOUS FLOATING OIL FILLING PEN

TECHNICAL FIELD

The disclosure relates to the technical field of self-made pens, in particular to a self-made LED luminous floating pen.

BACKGROUND

Except for pencils and crayons, we can divide them into water-based pens, medium-sized pens, and oil-based pens based on the ink. The ink used in oil-based pens is oily, insoluble in water, difficult to fade and melt; oil-based pens can write on absorption and non-absorption surfaces and are not easy to be erased; they are written on white paper, with obvious back marks on the flip side, and are often used in places where marks are needed.

At present, when children learn to write and draw, they often use oil pens. However, the function of oil pens is limited to writing and drawing, which can't attract children's interest. As a result, many children lose interest when they learn to write or draw, reducing the practicality of oil pens.

SUMMARY

In view of the above problems, the disclosure provides a self-made LED luminous floating oil pen, which has a floating action-figure, gold powder, mineral oil, plastic balls, and PVC pattern pieces; these decorations are put into an empty pen tube, poured with mineral oil, and then rotated and sealed. When the pen is reversed, the floating action figure and other decorations will move, and the floating action figure will slowly rise. Children can observe the movement of decorations in the pen tube while using the pen, which is fun.

In order to achieve the above purpose, the technical scheme adopted by the disclosure is as follows:

A self-made LED luminous floating oil-filled pen comprises an empty pen tube; one end of the empty pen tube is screwed with a plastic shell, and the inner cavity of the empty pen tube is filled with mineral oil. Two sides of the inner cavity of the empty pen tube are provided with LED lamp beads distributed at equal distances, and floating action figures, gold powder, and hollow plastic particles are arranged in the inner cavity of the empty pen tube.

Typically, the bottom inner cavity of the empty pen tube is arranged with seaweed, and the outer wall of the empty pen tube is installed with a sealing gasket.

Typically, the inner cavity of the empty pen tube is filled with PVC pattern sheets, and the shapes of the PVC pattern sheets are round, figurine, snowflake structure, etc.

Typically, the inner cavity of the plastic shell is clamped with a pen and ink tube, and the other end of the pen and ink tube is provided with a pen tip.

Typically, springs distributed equidistantly are installed on the outer wall of the bottom of the pen and ink tube, and the other end of the springs is equipped with a pressure sensor; the signal input end of the LED lamp bead is connected with the processor through a signal line, and the signal output end of the pressure sensor is connected with the signal input end of the processor through a signal line.

Typically, the outer wall of one side of the empty pen tube is provided with a pen cover matched with the specifications of the empty pen tube, and the outer wall of one side of the pen cover is installed with a pen holder.

Typically, the outer wall of one side of the plastic shell is installed with an anti-slip ring made of soft rubber.

The disclosure has that beneficial effect that:

1. The disclosure puts the floating action figure, gold powder, mineral oil, plastic balls, and PVC pattern pieces into an empty pen tube, then the mineral oil is poured before rotating and sealing; when the pen is inverted, the floating action figure and other decorations will drift, and the floating action figure will slowly rise so that children can observe the movements of decorations in the pen tube while using the pen, which is fun.

2. This disclosure sets the pen tip, the LED lamp bead, the pressure sensor, the spring in a way that when the pen tip is pressed to write, the pressure sensor transmits a signal to the processor; the processor acts on the switch of the LED lamp bead so that the empty pen tube can emit light, thereby improving the functional effect of the oil pen.

3. The disclosure includes the sealing gasket and the anti-slip ring, so that ink can be effectively prevented from leaking out of the plastic shell; the anti-slip ring can effectively prevent sliding when used by children; the rubber anti-slip ring can prevent children's fingers from being worn due to long-time writing, thereby improving the practicability of the device.

4. The oil pen of the disclosure can be assembled manually. The assembly process is interesting and helps to develop IQ.

In figure: 1. Empty pen tube; 2. Gasket; 3. Pen cap; 4. Pen holder; 5. Mineral oil; 6. PVC pattern sheet; 7. Plastic pellets; 8. LED lamp bead; 9. Gold powder; 10. Action figure; 11. Plastic particles; 12. Pen and ink tube; 13. Plastic shell; 14. Anti-skid ring; 15. Written; 16. Pressure sensor.

DESCRIPTION OF THE EMBODIMENTS

The following describes the technical scheme of the present disclosure regarding the drawings and examples.

Figure 1:
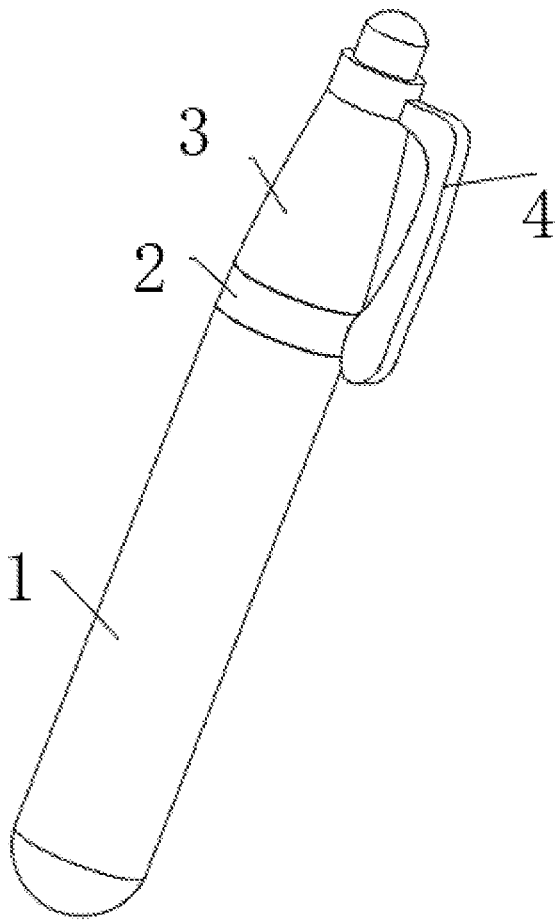
FIG. 1 is a perspective view of the present disclosure.
Figure 2:
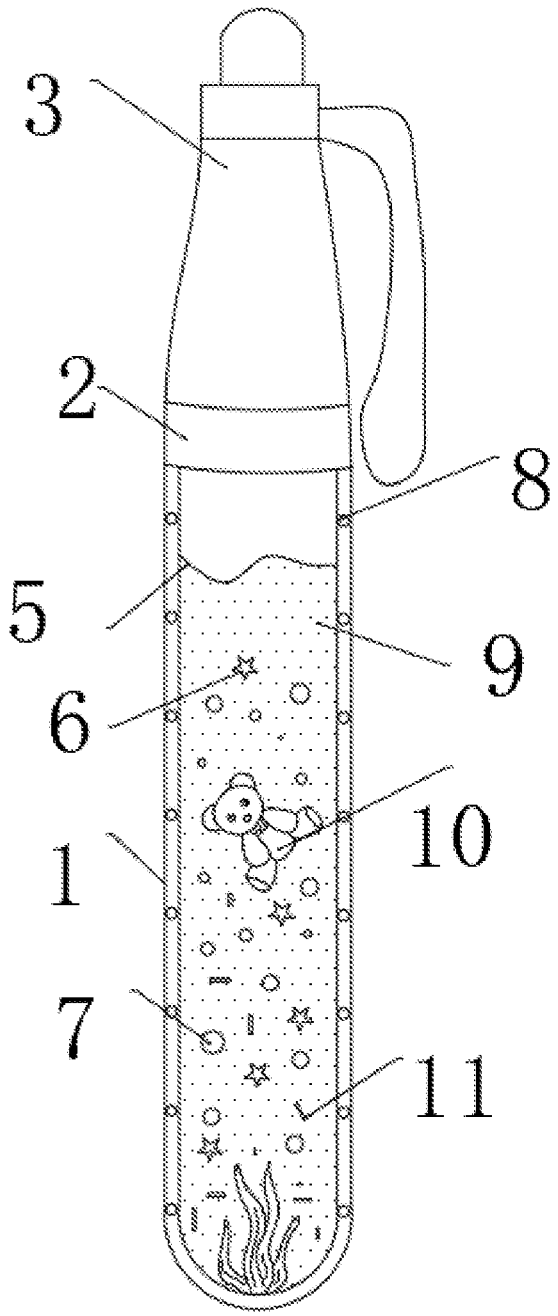
FIG. 2 is a schematic structural diagram of the floating action figure of the present disclosure.
Figure 3:
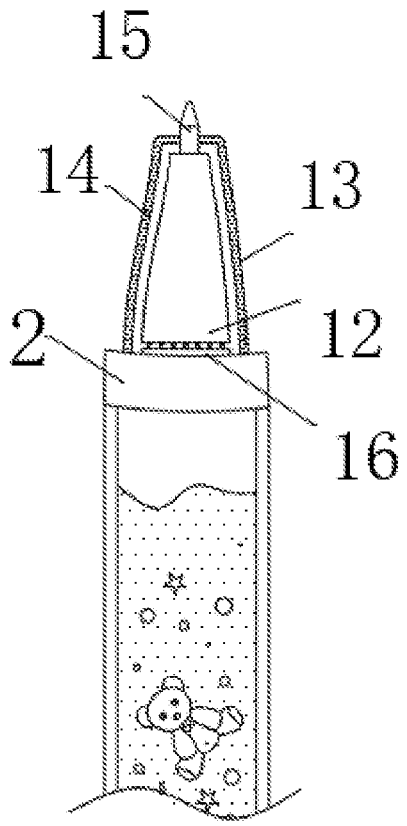
FIG. 3 is a schematic structural diagram of the anti-slip ring of the present disclosure.

As illustrated in FIG. 1 to FIG. 3, a self-made LED luminous floating oil pen according to the present disclosure comprises an empty pen tube 1, one end of which is screwed with a plastic shell 13, and the inner cavity of which is filled with mineral oil 5. Two sides of the inner cavity of the empty pen tube 1 are provided with LED lamp beads 8 installed at equal distances, and the inner cavity of the empty pen tube 1 is provided with floating action FIG. 10; gold powder 9, and plastic particles 11 are arranged in the inner cavity of the empty pen tube 1.

Specifically, the bottom inner cavity of the empty pen tube 1 is arranged with seaweed; the outer wall of the empty pen tube 1 is installed with a gasket 2, and the inner cavity of the empty pen tube 1 is provided with PVC pattern sheets 6; the shapes of the PVC pattern sheets are round, figurine, snowflake structure, etc.

Specifically, the inner cavity of the plastic shell 13 is clamped with a pen and ink tube 12, and the other end of the pen and ink tube 12 is installed with a pen tip 15. A pen cover 3 matched with the specification of the empty pen tube 1 is arranged on one outer wall of the empty pen tube 1, and the empty pen tube 1 is rotatably connected or clamped with the pen cover, and a pen clamp 4 is welded on the outer wall of the pen cover 3.

Specifically, the outer wall of one side of the plastic shell 13 is installed with an anti-slip ring 14 made of soft rubber.

The working principle of the disclosure is: There is a mobile power supply inside the device, which puts the floating action FIG. 10, gold powder 9, mineral oil 5, plastic balls 7, and PVC pattern pieces 6 into an empty pen tube, then mineral oil 5 is poured before rotating and sealing. When the pen is reversed, the floating action FIG. 10 and other decorations will drift and the floating action FIG. 10 will slowly rise. When the pen tip 15 is pressed, the spring presses the pressure sensor 16, and the pressure sensor 16 transmits a signal to the processor; when the processor acts on the switch of the LED lamp bead 8, the empty pen tube 1 will emit light. The sealing gasket 2 can effectively prevent pen and ink from leaking out of the plastic shell 13. The anti-slip ring 14 can effectively prevent sliding when children use it. The rubber anti-slip ring 14 can prevent children's fingers from wear by writing for a long time.

In the description of the present disclosure, it should be understood that the terms "upper", "lower", "left", "right", etc. indicate that the orientation or positional relationship is based on the orientation or positional relationship shown in the drawings, which is only for the convenience of illustrating and simplifying the description, and does not indicate or imply that the referred device or element must have a specific orientation, as well as a specific orientation configuration and operation to limit the disclosure. Also, "first" and "second" are only for descriptive purposes, and cannot be understood as indicating or implying relative importance or implicitly indicating the number of indicated technical features. Therefore, the features defined with "first" and "second" may include one or more of the features explicitly or implicitly. In the description of the present disclosure, unless otherwise specified, "plural" means two or more.

In the description of the present disclosure, it should be noted that unless otherwise specified and limited, the terms "installation" and "connection" should be broadly understood. For example, they can be fixed connections, detachable connections, or integrated connections; the connection can be mechanical or electrical; parts can be directly connected, indirectly connected through an intermediate medium, or communicated inside two elements. For ordinary technical personnel in this field, the specific meanings of the above terms in the present disclosure can be understood in specific situations.

An embodiment of the present disclosure has been described in detail above, but the content is only a preferred embodiment of the present disclosure and cannot be considered as limiting the implementation scope of the present disclosure. All equivalent changes and improvements made under the application scope of the present disclosure shall still fall within the patent coverage scope of the present disclosure.

What is claimed is:

1. A self-made LED luminous floating oil-filled pen, comprising an empty pen tube, wherein one end of the empty pen tube is threadedly connected to a plastic shell, and an inner cavity of the empty pen tube is filled with a mineral oil; wherein two sides of the inner cavity of the empty pen tube are provided with LED lamp beads distributed at equal distances, and the inner cavity of the empty pen tube is filled with floating action figures, gold powder, plastic particles, and a hollow plastic ball, wherein a seaweed is arranged in the inner cavity at a bottom of the empty pen tube, and a sealing gasket is arranged on an outer wall of the empty pen tube.

2. The self-made LED luminous floating oil pen of claim 1, wherein an inner cavity of the plastic shell is clamped with a pen and ink tube, and another end of the pen and ink tube is provided with a pen tip.

3. The self-made LED luminous floating oil pen of claim 2, wherein the inner cavity of the empty pen tube is provided with a PVC pattern sheet, which has a round, figurine, or snowflake structure.

4. The self-made LED luminous floating oil pen of claim 3, wherein there are provided springs that are distributed equidistantly on the outer wall of the bottom of the pen and ink tube, and another end of the springs is equipped with a pressure sensor), wherein a signal input end of the LED lamp bead is coupled to a processor through a signal line, and a signal output end of the pressure sensor is coupled to a signal input end of the processor through a signal line.

5. The self-made LED luminous floating oil pen of claim 1, wherein a pen cover matching the empty pen tube is arranged on one outer wall of the empty pen tube, and a pen clamp is arranged on one outer wall of the pen cover.

6. The self-made LED luminous floating oil pen of claim 1, wherein an anti-slip ring is installed on the outer wall of one side of the plastic shell, and wherein the anti-slip ring is made of a soft rubber.

7. The self-made LED luminous floating oil pen of claim 2, wherein an anti-slip ring is installed on the outer wall of one side of the plastic shell, and wherein the anti-slip ring is made of a soft rubber.

8. The self-made LED luminous floating oil pen of claim 3, wherein an anti-slip ring is installed on the outer wall of one side of the plastic shell, and wherein the anti-slip ring is made of a soft rubber.

9. The self-made LED luminous floating oil pen of claim 4, wherein an anti-slip ring is installed on the outer wall of one side of the plastic shell, and wherein the anti-slip ring is made of a soft rubber.

10. The self-made LED luminous floating oil pen of claim 5, wherein an anti-slip ring is installed on the outer wall of one side of the plastic shell, and wherein the anti-slip ring is made of a soft rubber.

* * * * *